US006123742A

United States Patent [19]

Smith

[11] Patent Number: 6,123,742

[45] Date of Patent: Sep. 26, 2000

[54] FUEL ADDITIVE

[76] Inventor: Eugene P. Smith, 424 New Ave., NE., Palm Bay, Fla. 32907

[21] Appl. No.: 09/370,162

[22] Filed: Aug. 9, 1999

[51] Int. Cl.[7] ..... C10L 1/18; C10L 1/16

[52] U.S. Cl. ..... 44/438; 44/439; 44/451

[58] Field of Search ..... 44/438, 439, 451

[56] References Cited

U.S. PATENT DOCUMENTS

| | | |
|---|---|---|
| 1,622,572 | 3/1927 | Chandler . |
| 1,925,048 | 8/1933 | Hennen . |
| 2,789,891 | 4/1957 | Brandes et al. . |
| 2,864,675 | 12/1958 | Jean . |
| 3,257,318 | 6/1966 | Cohen et al. . |
| 3,902,868 | 9/1975 | Zoch, Jr. . |
| 3,925,031 | 12/1975 | Villacampa . |
| 4,265,638 | 5/1981 | Burke . |
| 4,451,266 | 5/1984 | Barclay et al. . |
| 4,504,280 | 3/1985 | Efner et al. . |
| 4,634,452 | 1/1987 | Secor . |
| 4,743,272 | 5/1988 | Weinberger . |
| 4,806,129 | 2/1989 | Dorn et al. . |
| 5,688,295 | 11/1997 | Yang . |
| 5,931,977 | 8/1999 | Yang . |

*Primary Examiner*—Jerry D. Johnson
*Attorney, Agent, or Firm*—William M. Hobby, III

[57] ABSTRACT

A fuel additive for internal combustion engines contains a mixture of toluene, methanol, isopropyl alcohol, and mineral oil as base ingredients mixed with a mixture having acetone, methanol, toluene, and xylene mixed in a predetermined order in predetermined amounts. The fuel additive is added to an internal combustion engine fuel to improve the operation of the engine and reduce pollutants released into the atmosphere by the engine running the fuel and additive.

12 Claims, No Drawings

FUEL ADDITIVE

BACKGROUND OF THE INVENTION

This invention relates to a fuel additive composition for adding to the hydrocarbon fuel of an internal combustion engines to enhance the performance of the engine and reduce pollutants from the engine.

For many years, it has been customary to utilize separate chemicals to deal with various fuel problems. For example, it has been common to use kerosene to remove carbon deposits from an engine, to add alcohol to gasoline to render its moisture content miscible therewith, and to add a highly volatile component to provide a quick start to a sluggish engine. It is also well-known that the octane number of gasoline fuel may be increased (i.e. the knocking properties of gasoline may be reduced) by using increasingly-branched olefins, or aromatic hydrocarbons.

Prior U.S. Pat. No. 1,925,048, to Hennen is for a fuel composition and method. The composition is mixed with gasoline for use in internal combustion engines and includes benzol, trinitrotoluene, orthonitrochlorobenzene, technical white oil, castor oil, alphanaphthylamine, acetone, and butalacetate. The Barclay et al. U.S. Pat. No. 4,451,266, is an additive for improving the performance of liquid hydrocarbon fuels which uses a low molecular weight alcohol, an aliphatic ester, an aromatic hydrocarbon, a halogenated alkene, a hydroxy unsaturated vegetable oil and an aliphatic hydrocarbon for improving the fuel efficiency of an engine and providing cleaner burning by reducing engine deposits. The Villacampa U.S. Pat. No. 3,925,031, is a fuel and oil additive which contains naphthalene, camphor, toluene, benzyl alcohol, and gasoline and may include a small amount of lower alcohol, such as isopropyl alcohol or ethyl alcohol. The Efner et al. U.S. Pat. No. 4,504,280, is a fuel additive which includes vegetable oils, particularly soybean oil, tall oil acid, aralkyl acids, particularly phenylstearic acid, which are reacted with multiamines, particularly tetraethylenepentamine, to form a product mixture for subsequent reaction with $SO^2$ to produce a fuel additive with good detergent properties. The Zoch, Jr. U.S. Pat. No. 3,902,868, is for a fuel additive for addition in a vapor phase to a fuel, such as gasoline in the air/fuel mixing zone of an internal combustion engine for increasing the combustion efficiency and reducing the amount of pollution. The additive uses methanol, isopropanol, toluene, and methyl ethyl ketone. The Nelson et al. U.S. Pat. No. 4,753,661, is a fuel conditioner with a compatibilizing agent, such as alcohol, and includes an aromatic hydrocarbon. The Secor U.S. Pat. No. 4,634,452, is a fuel blend comprising tall oil and mineral and/or vegetable oil. In the U.S. Pat. No. 3,257,318, to Cohen, et al., a mineral oil base is used with a cleansing mixture of (a) a compound resulting from reacting a phosposulphurized hydrocarbon with an alkaline oxide and (b) an oil-soluble dispersant lubricating oil additive comprising a copolymer of C4–C18 alcohol fumarates, a butyl half ester of maleic acid and vinyl acetate in a mineral oil diluent. This invention is directed toward a cleansing and lubricating oil, but is not intended to be added to fuel.

It is the aim of this invention to furnish in a fuel additive as a single product formulation which may be added to gasoline fuel for an internal combustion engine, or in a preformulated fuel to enhance the fuel's performance and reduce pollution from the engine.

SUMMARY OF THE INVENTION

A fuel additive for internal combustion engines contains a mixture of toluene, methanol, isopropyl alcohol, and mineral oil as base ingredients mixed with a second mixture having acetone, methanol alcohol, and toluene, and xylene mixed in predetermined amounts. The fuel additive is added to an internal combustion engine hydrocarbon fuel to improve the operation of the engine and reduce pollutants released into the atmosphere by an engine running the fuel and additive. The fuel is made by mixing one ounce of fuel additive to one gallon of a liquid hydrocarbon fuel and includes by weight: toluene (50 to 55%), methanol (15 to 20%), isopropyl alcohol (12.5%), mineral oil (6.25%), acetone (3 to 10%), and xylene (2 to 4%).

DETAILED DESCRIPTION OF THE INVENTION

A fuel additive for internal combustion engines contains a mixture of toluene (C6H5CH3), alcohols, such as methanol (CH3OH), and isopropyl alcohol (CH3CH(OH)CH3), and mineral oil as base ingredients mixed with a mixture having acetone (CH3COCH3), Isopropyl alcohol, methanol, toluene and miscellaneous solvents such as methyl isobutyl ketone ((CH3)2CHCH2COCH3), methyl ethyl ketone (CH3COC2H5), 2-butoxyethanol (2-CH3CH2CH2CH2OCH2CH2OH), and xylene mixed in predetermined amounts. The fuel additive is added to an internal combustion engine fuel to improve the operation of the engine and reduce pollutants released into the atmosphere by the engine running the fuel and additive mixture. The fuel is made by mixing one ounce of fuel additive to one gallon of a liquid hydrocarbon fuel, such as heptane (C7H16), and a preferred formula includes by weight: toluene (50–55%), methanol (15 to 18%), isopropyl alcohol (10 to 15%), mineral oil (5 to 10%), acetone (3 to 10%). Miscellaneous solvents for the formula may include methyl isobutyl ketone (1 to 2%), methyl ethyl ketone (1 to 2%), 2-butoxyethanol (1 to 2%) and xylene (2 to 4%).

One or more alcohols in the composition are miscible with water and are combustible, and have no more than five carbon atoms, from 15 to 40 percent by weight, divided principally between methanol and Isopropyl alcohol. The perferred alcohol is methanol. Between 5 and 20 percent by weight of mineral oil is mixed with 25 to 50 percent by weight of toluene and 5 to 20 percent by weight of acetone.

The alcohol should be anhydrous; otherwise the effectiveness of the alcohol in "capturing" moisture content of the fuel is impaired. The miscibility of alcohol with water is superior with the branched-chain alcohols and tertiaryalcohols to that of the straight-chain primary alcohols. Also, tertiary butyl and amyl alcohols have lower boiling points than their straight-chain primary counterparts, but any of these alcohols may be used in this invention.

The incorporation of toluene provides a rich, supercharging fuel additive, as well as a solvent. Its anti-knock characteristics are well known.

In the preferred embodiment, a basic mixture, whose principal ingredients are toluene and alcohol premixed and this basic mixture added to a white grade mineral oil having a viscosity from ninety-five to one hundred SUS.

EXAMPLE 1

A fuel additive is prepared with a first mixture of 50 to 55 percent by weight of toluene, 15 to 18 percent by weight of methanol, 12.5 percent by weight of isopropyl alcohol, and 6.25 percent by weight of mineral oil as base ingredients which is mixed with a second mixture of 31 percent by weight including of a mixture in the following percent by weight: acetone (10% to 20), methanol (20 to 25%), toluene (30 to 45%), and xylene (7.5 to 12.5%). The parts are mixed in the predetermined amounts and one ounce is added to one gallon of an internal combustion engine hydrocarbon fuel to improve the operation of an engine and reduce pollutants released into the atmosphere by the engine running the fuel and additive.

EXAMPLE 2

An internal combustion engine fuel is made by mixing one ounce of fuel additive to one gallon of a liquid hydrocarbon fuel. The fuel additive includes by weight: toluene (50 to 55%), methanol (15 to 18%), isopropyl alcohol (12.5%), mineral oil (6.25%), and acetone (3 to 10%) and xylene (2 to 4%).

EXAMPLE 3

The method of making the compound requires mixing the basic mixture of toluene (50 to 55% by weight), methanol (10% to 18% by weight), and isopropyl alcohol (12.5% by weight) in any order. To this basic mixture, the mineral oil (6.25% by weight) is then added thereinto. A second composition is mixed with acetone (10 to 20% by weight), methanol (20 to 25% by weight), toluene (30 to 45% by weight), and xylene (3 to 4% by weight) and added to the basic mixture.

It should be clear at this time that a fuel additive composition and a method of making a fuel composition for adding to a hydrocarbon fuel for internal combustion engines has been disclosed. However, it should also be clear that the present invention is not to be construed as limited to the forms shown which are to be considered illustrative rather than restrictive.

I claim:

1. A fuel additive composition for use in internal combustion engines comprising:

(a) about 5 to 10 percent by weight of mineral oil;

(b) about 10 to 30 percent by weight of at least one alcohol selected from the group of alcohols having from one to five carbon atoms;

(c) about 30 to 50 percent by weight of toluene; and (d) about 3 to 10 percent by weight of acetone.

2. The composition according to claim 1 in which said at least one includes methanol.

3. The composition according to claim 1 wherein said at least one alcohol includes isopropyl alcohol.

4. The composition according to claim 1 in which said fuel additive composition has a range of methanol from 10 to 30 percent by weight.

5. The composition according to claim 4 in which said fuel additive composition has about 10 to 20 percent by weight of isopropyl alcohol.

6. The composition according to claim 5 in which said fuel additive composition has about 1 to 5 percent by weight of methyl isobutyl ketone.

7. The composition according to claim 6 in which said fuel additive composition has about 1 to 7.5 percent by weight of methyl ethyl ketone.

8. The composition according to claim 7 further comprising 2-butoxyethanol.

9. The composition according to claim 8 having about 2 to 4 percent by weight of xylene.

10. A method of making a fuel composition for use in internal combustion engines comprising the steps of:

mixing together a first composition of about 30 to 50 percent by weight of toluene, about 5 to 10 percent by weight of mineral oil and about 10 to 30 percent by weight of alcohol;

mixing together a second composition having about 10 to 20 percent by weight of acetone, about 30 to 45 percent by weight of toluene and about 20 to 25 percent by weight of alcohol;

mixing together said first and second compositions;

adding said mixed first and second compositions to a liquid hydrocarbon fuel for an internal combustion engine to form an improved fuel for an internal combustion engine.

11. The method of making a fuel composition in accordance with claim 10 in which the step of mixing together a second composition includes mixing about 3 to 4 percent xylene with said mixture of acetone, toluene, and alcohol.

12. The method of making a fuel composition in accordance with the method of claim 10 in which the step of mixing together a first composition includes first mixing together toluene and alcohol and then mixing the mineral oil thereto.

* * * * *